US007727025B2

(12) United States Patent
Fogg et al.

(10) Patent No.: US 7,727,025 B2
(45) Date of Patent: Jun. 1, 2010

(54) MODULAR ELECTRICAL CONNECTOR WITH ENHANCED PLUG INTERFACE

(75) Inventors: Michael Warren Fogg, Harrisburg, PA (US); Randall Robert Henry, Harrisburg, PA (US); Michael John Phillips, Camp Hill, PA (US); Robert Charles Trea, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/869,553

(22) Filed: Oct. 9, 2007

(65) Prior Publication Data

US 2009/0093166 A1 Apr. 9, 2009

(51) Int. Cl.
*H01R 24/00* (2006.01)

(52) U.S. Cl. ..... 439/660

(58) Field of Classification Search ..... 439/660, 439/676, 607, 610, 941, 906

See application file for complete search history.

(56) References Cited

U.S. PATENT DOCUMENTS

| | | | | | |
|---|---|---|---|---|---|
| 3,760,335 | A * | 9/1973 | Roberts | 439/398 |
| 5,197,901 | A * | 3/1993 | Hashiguchi | 439/352 |
| 5,273,459 | A * | 12/1993 | Davis | 439/607 |
| 5,340,333 | A * | 8/1994 | Schroth | 439/607 |
| 5,342,216 | A * | 8/1994 | Davis et al. | 439/362 |
| 5,409,400 | A * | 4/1995 | Davis | 439/610 |
| 5,462,457 | A | 10/1995 | Schroepfer | |
| D367,039 | S * | 2/1996 | Loh | D13/147 |
| 5,947,761 | A | 9/1999 | Pepe | |
| 6,120,329 | A | 9/2000 | Steinman | |
| 6,270,381 | B1 * | 8/2001 | Adriaenssens et al. | 439/676 |
| 6,273,740 | B1 * | 8/2001 | Lord | 439/353 |
| 6,319,069 | B1 * | 11/2001 | Gwiazdowski | 439/676 |
| 6,328,601 | B1 * | 12/2001 | Yip et al. | 439/608 |
| 6,655,988 | B1 | 12/2003 | Simmons et al. | |
| 6,887,091 | B1 * | 5/2005 | Wu | 439/352 |
| 7,048,550 | B2 | 5/2006 | Hyland et al. | |
| 7,195,518 | B2 | 3/2007 | Bert et al. | |
| 7,207,807 | B2 | 4/2007 | Fogg | |
| 2003/0003799 | A1 * | 1/2003 | Winings | 439/541.5 |

* cited by examiner

*Primary Examiner*—Alexander Gilman

(57) ABSTRACT

An electrical connector includes a plug body having a cavity defined by outer body walls. The cavity has a cavity axis extending between a mating end and a base end of the cavity. The plug body also includes a web portion within the cavity, wherein the web portion extends along the cavity axis and includes a first side and a second side. The first and second sides are spaced apart from, and generally face, corresponding ones of the outer body walls. The plug body is configured to be received within a receptacle of a mating connector, and a portion of the mating connector is received within the cavity along the first and second sides of the web portion when the plug body is mated within the mating connector. The electrical connector also includes a plurality of contacts arranged on the web portion in differential pairs, wherein a first differential pair of contacts is positioned on the first side and a second differential pair of contacts is positioned on the second side for interfacing with the mating connector.

21 Claims, 8 Drawing Sheets

MODULAR ELECTRICAL CONNECTOR WITH ENHANCED PLUG INTERFACE

BACKGROUND OF THE INVENTION

The subject matter herein relates generally to electrical connectors, and more particularly, to electrical connectors having an enhanced plug interface.

In electrical systems, there is increasing concern for preserving signal integrity as signal speed and bandwidth increase. One source of signal degradation is crosstalk between multiple signal paths. In the case of an electrical connector carrying multiple signals, crosstalk occurs when signals conducted over a first signal path are partly transferred by inductive or capacitive coupling into a second signal path. The transferred signals produce crosstalk in the second path that degrades the signal routed over the second path.

For example, a typical industry standard type RJ-45 communication connector includes four pairs of contacts defining different signal paths. The RJ-45 plug and jack designs are dictated by industry standards and are inherently susceptible to crosstalk. In conventional RJ-45 plug and jack connectors, all four pairs of contacts extend closely parallel to one another over a length of the connector body. One pair of contacts is also split around another contact pair. Thus, signal crosstalk may be induced between and among different pairs of connector conductors. The amplitude of the crosstalk, or the degree of signal degradation, generally increases as the frequency increases. More crosstalk can be created by the contacts in the jack that interface with the contacts in the plug. As signal speed and density increase, alien crosstalk, or crosstalk between neighboring connectors should also be addressed in preserving signal integrity.

At least some RJ-45 jacks include features that are intended to suppress or compensate for crosstalk. The shortcomings that are inherent in jacks such as the RJ-45 can be expected to become more serious as system demands continue to increase. It would be desirable to develop a connector that is designed to minimize both internal crosstalk and alien crosstalk at the outset rather than to correct for crosstalk after the fact.

BRIEF DESCRIPTION OF THE INVENTION

In one embodiment, an electrical connector is provided including a plug body having a cavity defined by outer body walls. The cavity has a cavity axis extending between a mating end and a base end of the cavity. The plug body also includes a web portion within the cavity, wherein the web portion extends along the cavity axis and includes a first side and a second side. The first and second sides are spaced apart from, and generally face, corresponding ones of the outer body walls. The plug body is configured to be received within a receptacle of a mating connector, and a portion of the mating connector is received within the cavity along the first and second sides of the web portion when the plug body is mated within the mating connector. The electrical connector also includes a plurality of contacts arranged on the web portion in differential pairs, wherein a first differential pair of contacts is positioned on the first side and a second differential pair of contacts is positioned on the second side for interfacing with the mating connector.

Optionally, the cavity may include a first channel extending along the first side of the web portion and a second channel extending along the second side of the web portion. The first and second channels may be configured to receive portions of the mating connector, wherein the contacts are exposed to one of the first and second channels for mating engagement with the mating connector. The cavity may completely surround the web portion along the cavity axis. Optionally, the outer walls may include first and second side walls and first and second end walls extending between the first and second side walls, wherein the first and second sides of the web portion are parallel to, and spaced apart from, the first and second side walls, and wherein the web portion extends from at least one of the end walls. The plug body may be configured to be received within the receptacle of the mating connector in a co-nested arrangement having the plug body surrounded by the receptacle and having the plug body surrounding a perimeter of a portion of the mating connector along a mating axis. The cavity may be configured to receive a mating portion of the mating connector such that the mating portion of the mating connector extends along and engages the contacts positioned on both the first side and the second side of the web portion. In another embodiment, the electrical connector includes a plug body having an outer perimeter extending between a mating end and a wire terminating end. The outer perimeter is configured to be received within a receptacle of a mating connector when mated thereto, and the plug body has a cavity open at the mating end for receiving a portion of the mating connector. The plug body has wire receiving ports at the wire terminating end for receiving individual wires therein. The electrical connector also includes a plurality of contacts positioned within the cavity for mating with the mating connector. The contacts are configured to be electrically connected to respective ones of the wires, and the contacts are arranged as differential pairs. The contacts of a first differential pair are arranged along a first plane and the contacts of a second differential pair are arranged along a different second plane that is substantially parallel to the first plane.

In a further embodiment, an electrical connector is provided including a plug body having a first mating end and a second mating end. The first mating end has an outer perimeter configured to be received within a receptacle of a first mating connector when mated thereto. The plug body has a cavity and web portion at the first mating end, wherein the cavity is configured for receiving a portion of the first mating connector and the web portion is configured for plugging into a portion of the first mating connector. The second mating end has mating contacts for engaging a second mating connector. The electrical connector includes a plurality of contacts received within the cavity for mating with the first mating connector, wherein the contacts are arranged on the web portion in differential pairs. A first differential pair of contacts is positioned on a first side of the web portion and a second differential pair of contacts is positioned on a second side of the web portion. The contacts are electrically connected to respective ones of the mating contacts at the second mating end of the plug body.

DETAILED DESCRIPTION OF THE INVENTION

Figure 1:
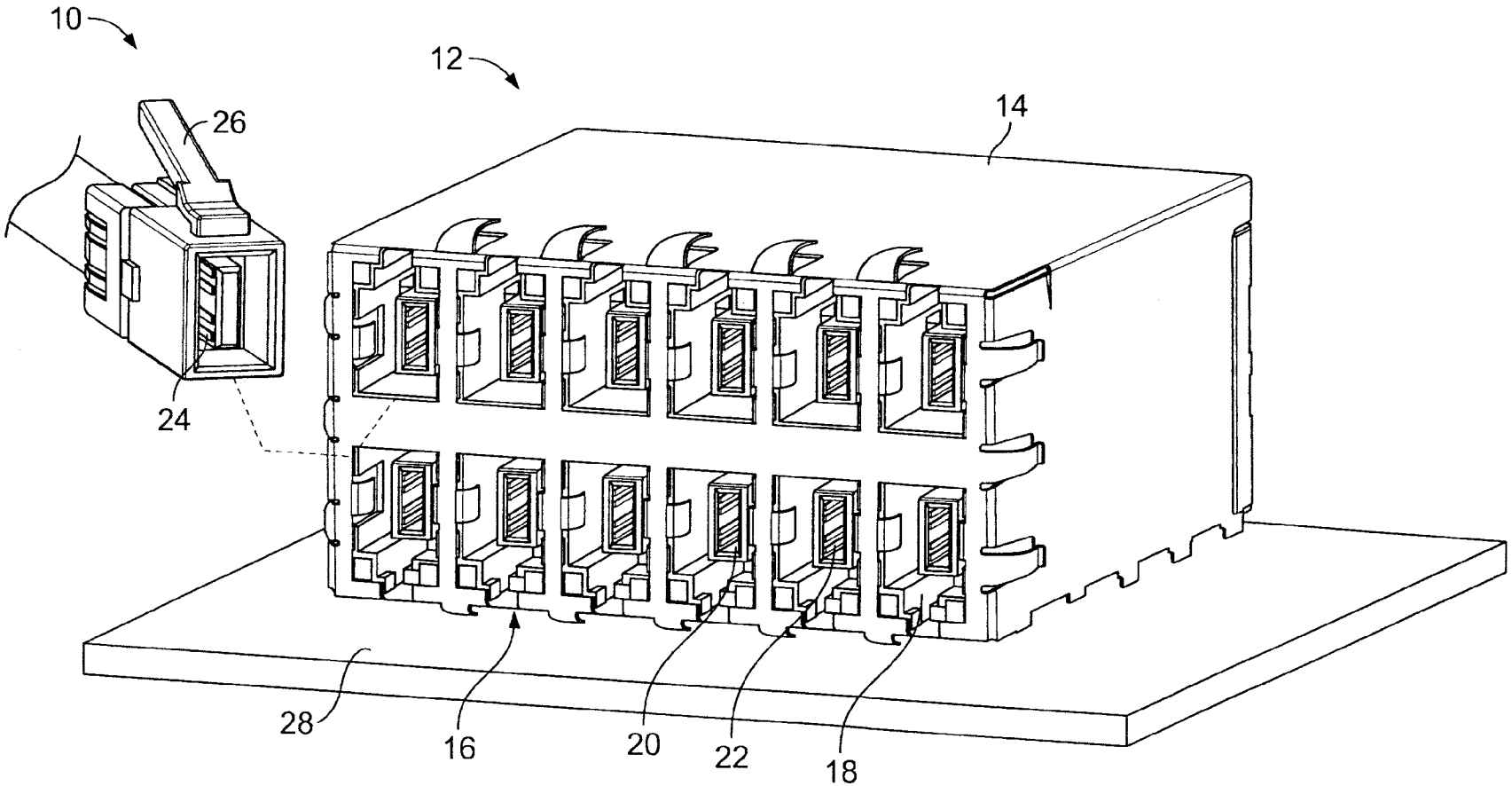
FIG. 1 is a perspective view of an exemplary electrical connector formed in accordance with an exemplary embodiment for mating with a mating connector.

FIG. 1 is a perspective view of an exemplary electrical connector 10 formed in accordance with an exemplary embodiment. The electrical connector 10 represents a plug connector that may be mated with a mating connector 12, represented by the receptacle connector in FIG. 1. The electrical connector 10 and the mating connector 12 are modular connectors, such as the types of electrical connectors used for connecting telecommunications equipment or computer networking equipment. In the illustrated embodiment, the electrical connector 10 and the mating connector 12 are eight pin, eight conductor (8P8C) modular connectors having signal pairs, however the subject matter described herein also has applicability to other connectors having fewer or greater numbers of pins, conductors and/or signal pairs.

In an exemplary embodiment, the mating connector 12 includes a housing 14 having multiple communication ports 16 opening to receptacles 18 that receive respective ones of the electrical connectors 10. The mating connector 12 also includes contact support members 20 that are arranged within respective ones of the receptacles 18. Each of the contact support members 20 includes a plurality of mating contacts 22 arranged along a mating interface for mating with corresponding contacts 24 of the electrical connector 10. For example, the mating contacts 22 and the contacts 24 are arranged in similar patterns for mating engagement. Optionally, the mating contacts 22 and contacts 24 are arranged, or grouped, as differential signal pairs. In an exemplary embodiment, the electrical connector 10 includes a latch 26 on an exterior surface thereof for securing the electrical connector 10 within the receptacle 18.

The housing 14 is mounted to a substrate 28. Optionally, the substrate 28 may represent a circuit board and the electrical connector may be mechanically and electrically connected to the circuit board for sending and receiving signals. The substrate 28 and mating connector 12 may be mounted within an electrical device or apparatus having a communications port through which the device may communicate with other externally networked devices. Alternatively, the mating connector 12 may be wall mounted or panel mounted for connection with the electrical connectors 10. In some embodiments, the mating connector 12 may include only a single receptacle 18 and corresponding contact support member 20 for mating with a single electrical connector 10. Additionally, in some embodiments, rather than sending and receiving the signals via a circuit board, the mating connector 12, or more particularly, the contact 22, may be terminated to an end of a cable (not shown).

Figure 2:
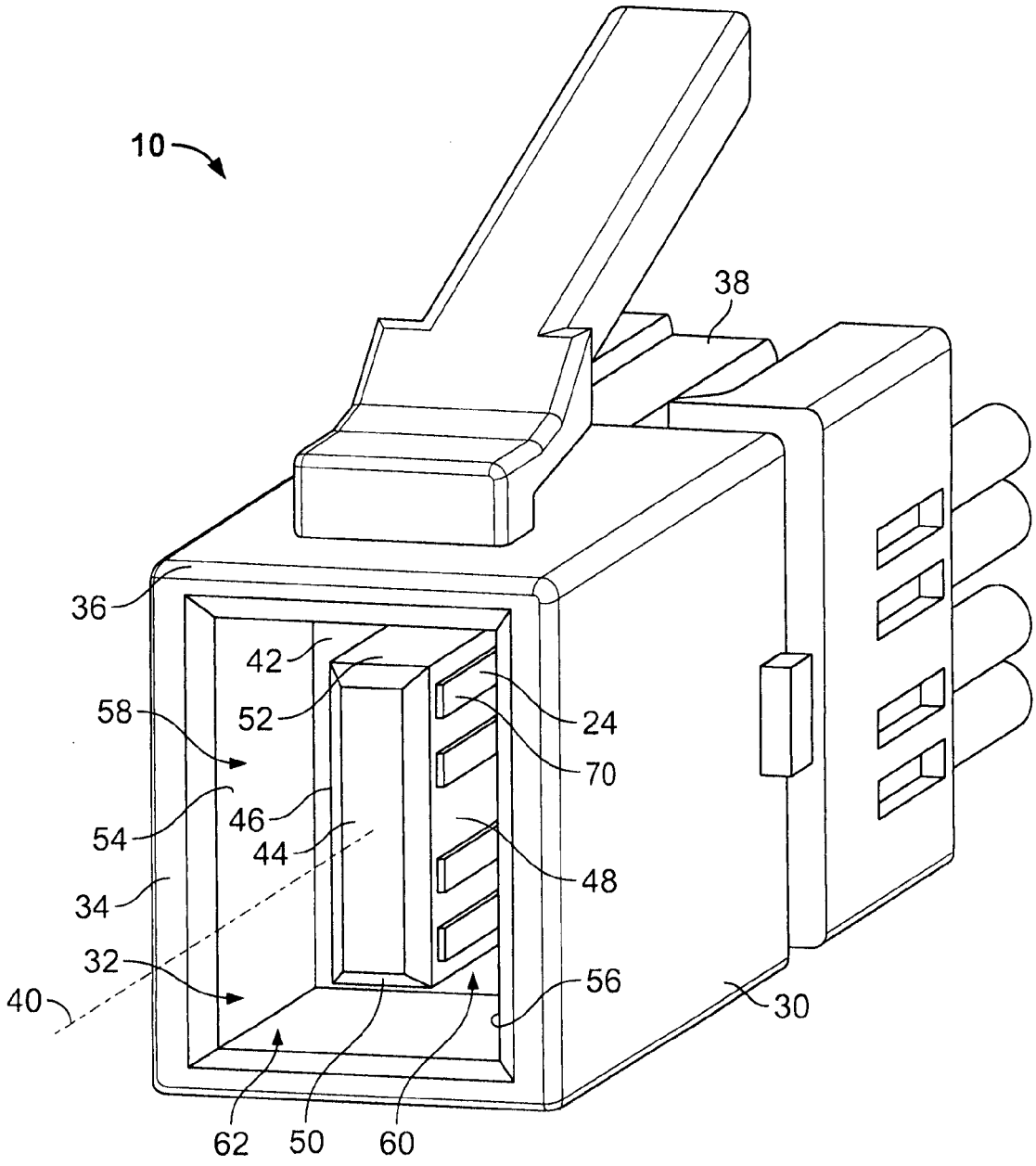
FIG. 2 illustrates the electrical connector shown in FIG. 1.

FIG. 2 illustrates the electrical connector 10 from a different perspective as FIG. 1. The electrical connector 10 includes a plug body 30 having a cavity 32 defined by outer body walls 34 that define a perimeter of the plug body 30. The outer body walls 34 extend between a mating end 36 and a terminating end 38 of the plug body 30. The cavity 32 extends along a cavity axis 40 from the mating end 36 to a base end 42 of the cavity 32. The cavity 32 is open at the mating end 36 for receiving the contact support member 20 (shown in FIG. 1) of the mating connector 12 when the electrical connector 10 is plugged into the receptacle 18 (shown in FIG. 1). As such, the electrical connector 10 and the mating connector 12 are co-nested with one another when mated. For example, the receptacles 18 of the mating connector 12 surround a perimeter of the outer body walls 34, and the outer body walls surround a perimeter of the contact support member 20. As such, at least a portion of the electrical connector 10 is received within the mating connector 12 and at least a portion of the mating connector 12 is received within the electrical connector 10.

The electrical connector 10 includes a web portion 44 within the cavity 32. The web portion 44 extends from the base end 42 of the cavity 32 generally along the cavity axis 40. Optionally, the web portion 44 may be coincident with the cavity axis 40. The web portion 44 includes a first side 46 and a generally opposed second side 48. Ends 50, 52 extend between the sides 46, 48 such that the web portion 44 has a generally rectangular cross-sectional shape. However, the web portion 44 may have an alternative shape, including non-planar wall surfaces, in alternative embodiments.

In an exemplary embodiment, the first and second sides 46, 48 are spaced apart from, and generally face, first and second side walls 54, 56, respectively, of the outer body walls 34. As such, a first channel 58 is formed between the first side 46 of the web portion 44 and the first side wall 54, and a second channel 60 is formed between the second side 48 of the web portion 44 and the second side wall 56. The first and second channels are generally parallel to one another and are adapted to receive the contact support member 20 of the mating connector 12. Optionally, as illustrated in FIG. 2, connecting channels 62 extend between, and connect, the first and second channels 58, 60. The connecting channels 62 extend between the ends 50 and 52 and the outer body walls 34. As such, the cavity 32, defined at least in part by the channels 58, 60, 62 completely surrounds the web portion 44 along the cavity axis 40. Alternatively, the web portion 44 may extend from at least one of the outer body walls 34, such as one of the outer body walls 34 connecting the first and second side walls 54, 56, such that the cavity 32 only includes one connecting channel 62, or alternatively, no connecting channels 62. The channels 58, 60 and 62 cooperate to define a mating interface that is adapted to receive the contact support member 20 of the mating connector 12.

The contacts 24 are provided within the cavity 32 for interfacing with the mating contacts 22 (shown in FIG. 1) of the mating connector 12. In an exemplary embodiment, the contacts 24 are arranged on the web portion 44. The contacts 24 extend between a mating end 70 and a termination end 72 (shown in FIG. 3) proximate the terminating end 38 of the plug body 30. The mating end 70 is exposed within the cavity 38 for engaging the mating contacts 22. In an exemplary embodiment, the contacts 24 are arranged as differential pairs, wherein the contacts 24 of a respective differential pair are aligned with, and substantially co-planar with one another. In the illustrated embodiment, four differential pairs are provided, having two differential pairs on each of the sides 46, 48 of the web portion 44. As such, a first differential pair and a second differential pair are arranged on the first side 46, and the contacts 22 of the first and second differential pairs are substantially aligned with one another along a first plane. Similarly, a third differential pair and a fourth differential pair are arranged on the second side 48, and the contacts 22 of the third and fourth differential pairs are substantially aligned with one another along a second plane that is non-coplanar with the first plane. Optionally, the first and second planes may be substantially parallel with, and spaced apart from, one another.

Figure 3:
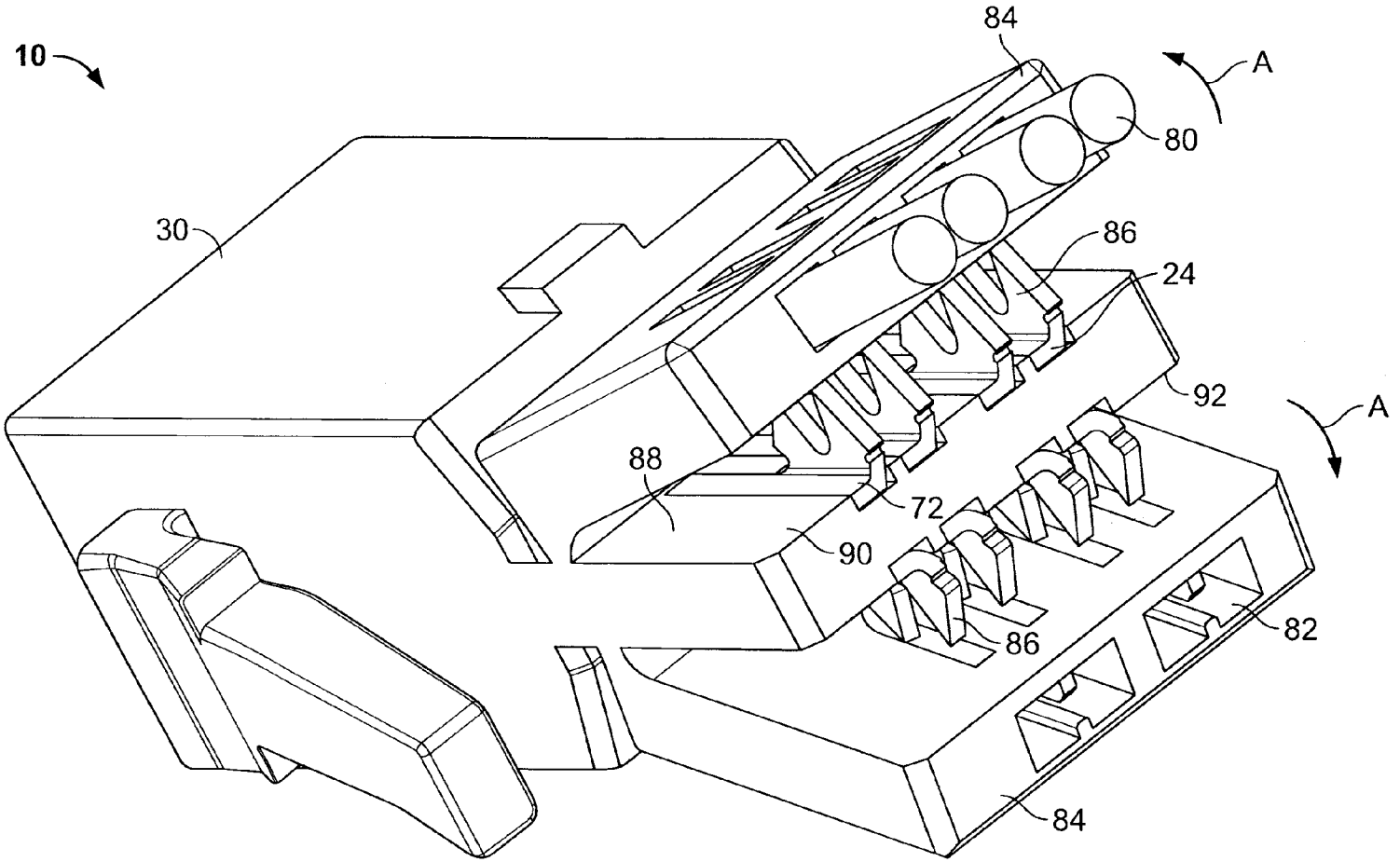
FIG. 3 is a rear view of the electrical connector shown in FIG. 1 in an unassembled state.
Figure 4:
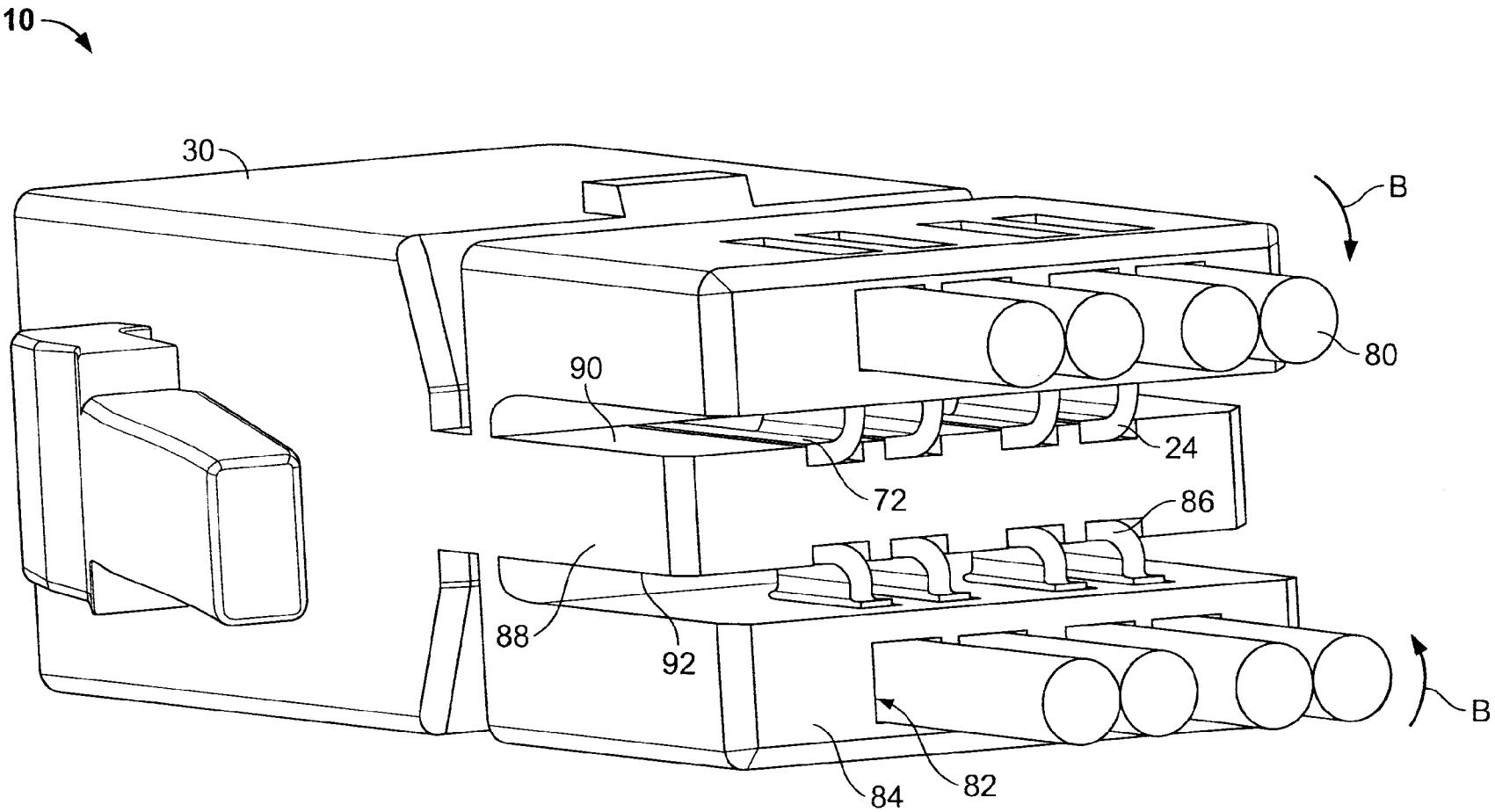
FIG. 4 is a rear view of the electrical connector shown in FIG. 1 in an assembled state.

FIG. 3 is a rear view of the electrical connector 10 in an unassembled state illustrating wires 80 positioned for mating with the contacts 24 of the electrical connector 10. FIG. 4 is a rear view of the electrical connector 10 in an assembled state illustrating the wires 80 mated with the contacts 24 of the electrical connector 10. FIG. 3 illustrates four discrete wires 80 loaded into wire receiving ports 82 of the plug housing 30, while FIG. 4 illustrates eight wires 80 loaded into the wire receiving ports 82.

In an exemplary embodiment, the wire receiving ports 82 are provided on hinged wire receiving elements 84 that form part of, or are coupled to, the plug body 30. The wire receiving elements 84 are movable between an unmated position, such as the position illustrated in FIG. 3, and a mated position, such as the position illustrated in FIG. 4. In the unmated position, the wire receiving elements 84 are rotated outward from the plug body 30, such as in the direction of arrow A, to a position in which the wires 80 may be inserted into the wire receiving ports 82. In the mated position, the wire receiving elements 84 are rotated generally toward the plug body 30, such as in the direction of arrow B, to a position in which the wires 80 may be terminated to the contacts 24. In operation, the wires 80 are loaded into the wire receiving ports 82 and then the wire receiving elements 84 are moved to the mated position. When the wires 80 are in the mated position, the wires may be terminated to the contacts 24. In an alternative embodiment, rather than being coupled to the plug body 30 and rotated between the assembled and un-assembled positions, the wire receiving elements 84 may be separately provided from the plug body 30 and then mounted to the plug body 30.

In an exemplary embodiment, the termination ends 72 of the contacts 24 include insulation displacement contact (IDC) terminals 86 extending therefrom. Optionally, the IDC terminals 86 may extend generally outward from a contact support member 88 of the plug body 30. For example, some of the contacts 24 may extend along a first side 90 of the contact support member 88 and some of the contacts 24 may extend along a second side 92 of the contact support member 88. The first and second sides 90, 92 may be substantially aligned with the first and second sides 46, 48 (shown in FIG. 1) of the web portion 44 (shown in FIG. 1) such that each contact 24 is substantially linear along its length from the mating end 70 to the termination end 72.

In alternative embodiments, rather than extending outward, the IDC terminals 86 may extend generally rearward from the termination ends 72 of the contacts 24, such as in a direction along the contacts 24. In other alternative embodiments, the wire termination ends 72 may be terminated to the wires 80 using other types of connections or methods, such as soldering, crimping, and the like. The wires 80 may also be indirectly connected to the contacts 24, such as by a circuit board, wherein the contacts 24 are connected to the circuit board, the wires 80 are connected to the circuit board, and traces along the circuit board are used to interconnect the wires 80 and the contacts 24.

Figure 5:
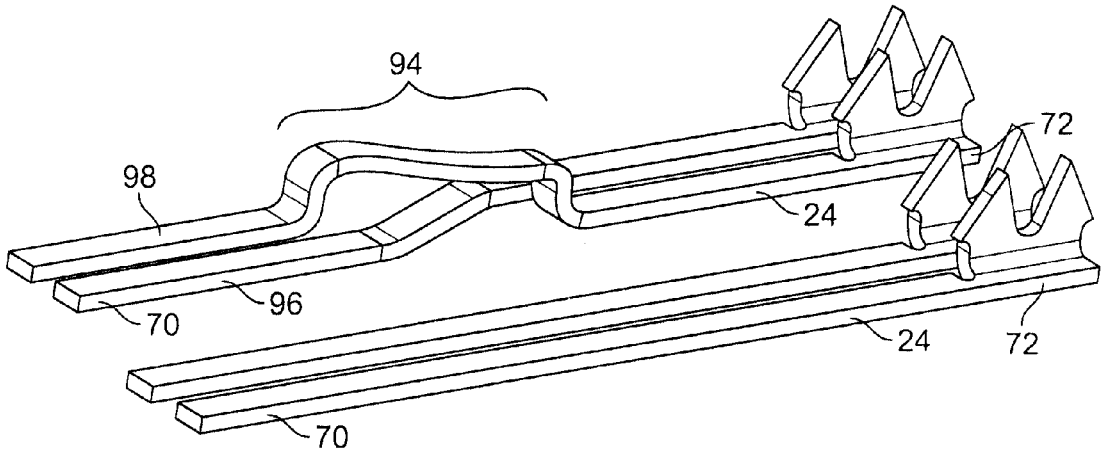
FIG. 5 illustrates a pair of contacts for the electrical connector shown in FIG. 1 and formed in accordance with an exemplary embodiment.

FIG. 5 illustrates two pairs of contacts 24 for the electrical connector and formed in accordance with an exemplary embodiment. The two pairs of contacts 24 may be arranged on one of the first or second sides 46, 48 of the web portion 44 (shown in FIG. 2). One of the pairs of contacts 24 includes a cross-over section 94, while the other pair of contacts 24 extend linearly between the mating end 70 and the termination end 72. The cross-over section 94 may be used to control the intra-pair electrical interactions between the contacts within the differential pair, and/or the cross-over section 94 may be used to control the inter-pair electrical interaction between contacts of adjacent differential pairs. Optionally, both pairs of contacts 24 may include cross-over sections 94, or alternatively, neither of the pairs of contacts 24 may include a cross-over section 94.

The relative positions of the contacts 24 in either side of the cross-over section 94 are changed, such as being reversed. For example, a first contact 96 represents an inner contact (as compared to the adjacent differential pair) proximate the mating end 70, but then represents an outer contact (as compared to the adjacent differential pair) proximate the termination end 72. Similarly, a second contact 98 represents an inner contact (as compared to the adjacent differential pair) proximate the termination end 72, but then represents an outer contact (as compared to the adjacent differential pair) proximate the mating end 70. Optionally, at least one of the contacts 24 may be non-planar to create the cross-over section 94, however, the contacts remain generally planar along the majority of the length of the contacts 24. The contacts 24 may also be generally co-planar with the adjacent pair of contacts 24.

Within the electrical connector 10 (shown in FIG. 1), at least some of the differential pairs may include contacts having the cross-over sections 94. For example, two of the differential pairs, such as differential pairs that are not on the same side of the web portion 44 (shown in FIG. 1) and that are not aligned across the web portion 44 from one another, may include cross-over sections 94, while the other two differential pairs do not include cross-over sections 94, but rather are passed straight through the plug body 30 from the mating end 70 to the termination end 72.

Figure 6:
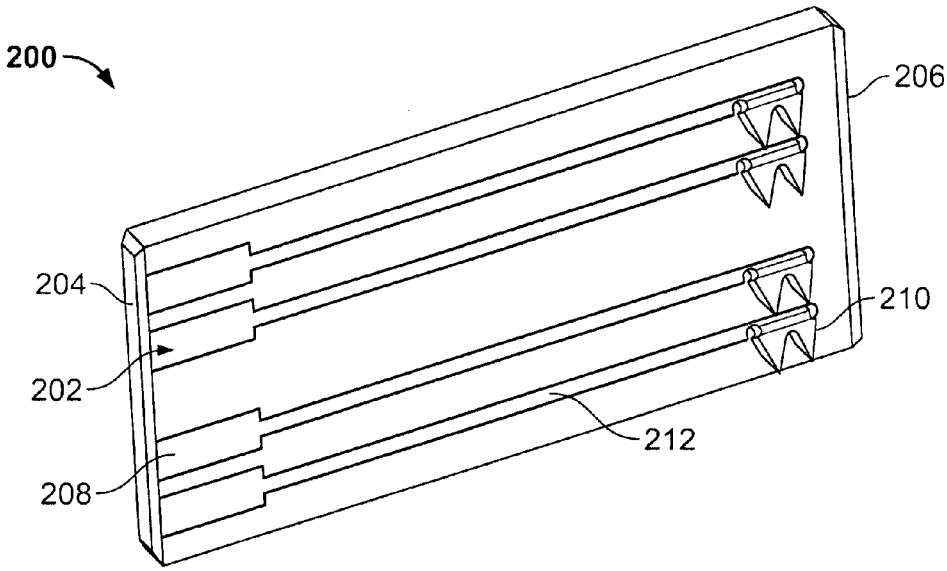
FIG. 6 illustrates a circuit board having contacts thereon that may be used in alternative electrical connectors.

FIG. 6 illustrates a circuit board 200 that may be received within a plug body of an alternative electrical connector. The circuit board 200 includes a plurality of contacts 202 extending between a mating end 204 and a terminating end 206 of the circuit board 200. The circuit board 200 and contacts 202 may replace the individual contacts 24 (shown in FIG. 2) and web portion 44 (shown in FIG. 2) of the electrical connector 10 (shown in FIG. 1). For example, when the circuit board 200 is received within the plug body, the circuit board 200 may define a web portion having contacts thereon.

In the illustrated embodiment, the contacts 202 include contact pads 208 at the mating end 204 and IDC 210 at the terminating end 206. Traces 212 extend between the contact pads 208 and the IDC 210. Optionally, the traces 212 may be routed in predetermined patterns to provide electrical compensation, or to control the electrical characteristics and/or interactions between and among each of the contacts 202. The IDC 210 may be terminated to the circuit board 200 by mounting within through holes in the circuit board 200, by surface mounting, such as by soldering, and the like. In an alternative embodiment, the circuit board 200 may have alternative termination contacts at the terminating end 206 rather than the IDC 210, such as contact pads, crimp contacts, and the like.

Figure 7:
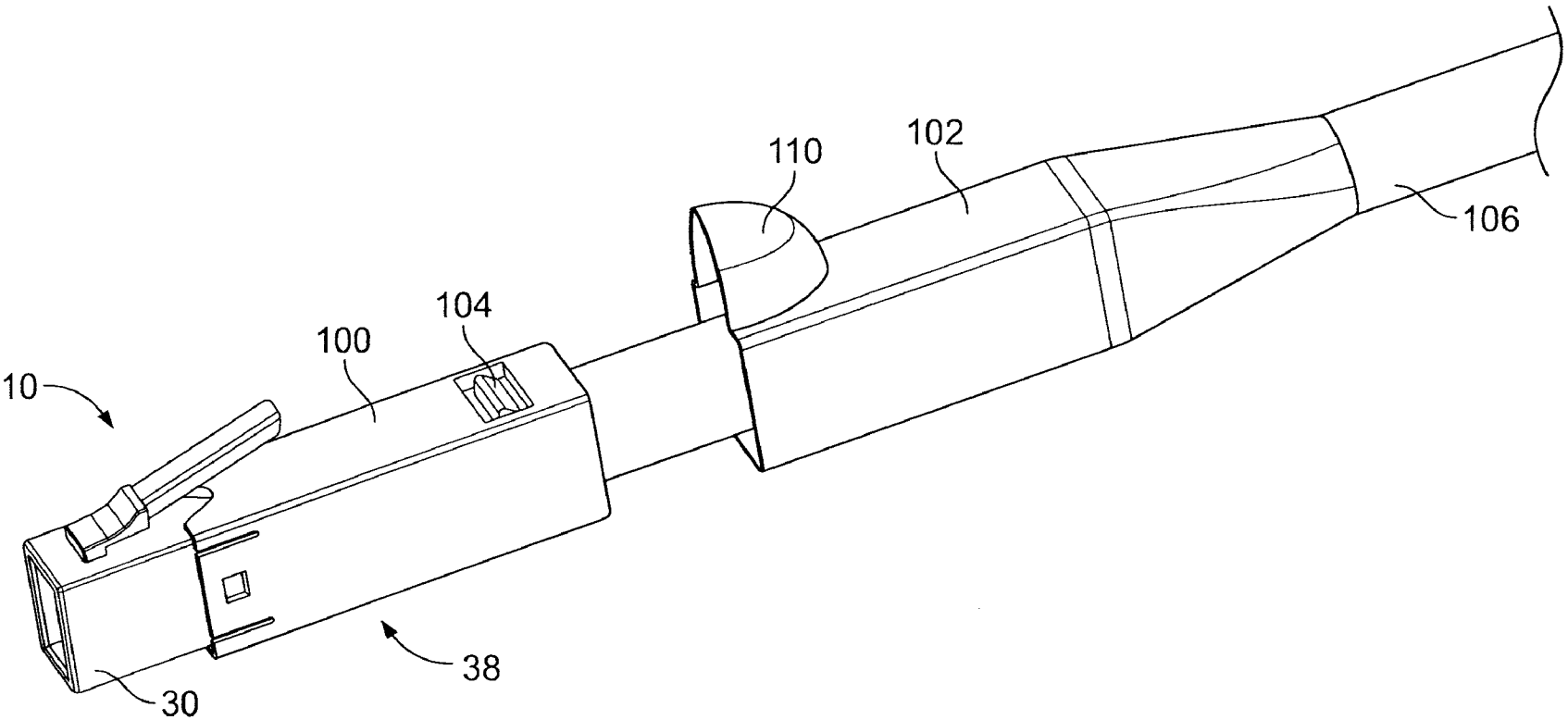
FIG. 7 illustrates a strain relief and boot shroud that may be used with the electrical connector shown in FIG. 1.

FIG. 7 illustrates a strain relief 100 and boot shroud 102 that may be used with the electrical connector 10. The strain relief 100 may be coupled to the terminating end 38 of the plug body 30. The strain relief 100 also includes a crimp section 104 that is securely coupled to a cable 106 having the wires 80 (shown in FIGS. 3 and 4). The boot shroud 102 may cover at least a portion of the strain relief 100 and the plug body 30. The boot shroud 102 includes a hood 110 that covers at least a portion of the latch 26. Optionally, in shielded applications, the strain relief 100 may define a shield that is mechanically and electrically connected to a shield of the cable 106.

Figures 8, 9:
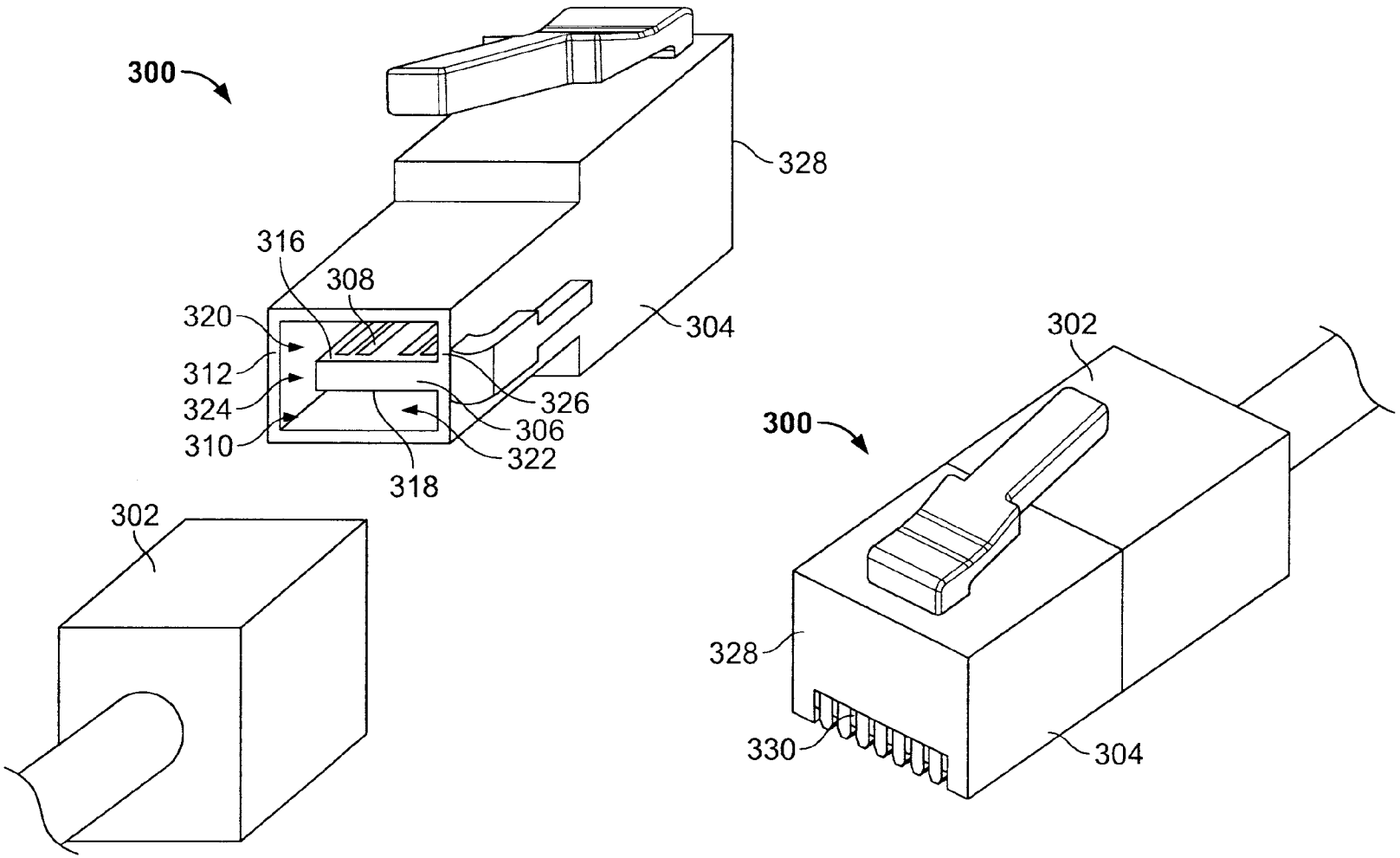
FIG. 8 is a front perspective view of another electrical connector formed in accordance with an alternative embodiment.
FIG. 9 is a rear perspective view of the electrical connector shown in FIG. 7.

FIGS. 8 and 9 are front and rear perspective views of another electrical connector 300 formed in accordance with a further alternative embodiment. A mating connector 302 may be interconnected with the electrical connector 300, such as illustrated in FIG. 9. The electrical connector 300 includes a plug body 304 and a web portion 306 having a plurality of first mating contacts 308 for mating with the mating connector 302. The electrical connector 300 represents a plug connector having a cavity 310 that receives at least a portion of the mating connector 302.

The plug body 304 includes outer body walls 312 defining an outer perimeter of the plug body 304. The outer perimeter of the plug body 304 defines a mating interface that is received within a receptacle of the mating connector 302. The web portion 306 is provided within the cavity 310. The web portion 306 includes opposed sides 316, 318 and extends from one of the outer body walls 312. First and second channels 320, 322 and a connecting channel 324 are formed between the web portion 306 and the outer body walls 312. The channels 320, 322, 324 define a space sized and shaped to accept a portion of the mating connector therein. The first mating contacts 308 extend along the first and second sides 316, 318 of the web portion 306 such that the first mating contacts 308 face, and are exposed to, respective ones of the channels 320, 322.

The plug body 304 extends between a first mating end 326 and a second mating end 328. The electrical connector 300 defines a plug connector at the first mating end 326 for connection with a receptacle-type mating connector 302. The first mating end 326 and the mating connector 302 have a mating interface defined for use within a first wiring system, wherein plugs and receptacles within the first wiring system have a mating interface similar to that shown in FIGS. 8 and 9. As shown in FIG. 9, the electrical connector 300 defines a plug type connector at the second mating end 328 for mating with a corresponding receptacle type of connector (not shown). The second mating end 328 and the corresponding connector have a mating interface defined for use within a second wiring system, wherein plugs and receptacles within the second wiring system have a mating interface similar to that shown in FIGS. 8 and 9. The mating interface defined at the second mating end 328 is different than the mating interface at the first mating end 326, such that the second mating end 328 could not be plugged into the mating connector 302. The electrical connector 300 may be used as an adaptor for interconnecting components or cables from the first wiring system with components or cables from the second wiring system.

In an exemplary embodiment, the second mating end 328 represents an 8P8C modular connector, such as an RJ-45 plug or other type of connector used within a network cabling system. The second mating end 328 includes second mating contacts 330. In the illustrated embodiment, eight second mating contacts 330 are provided and the second mating contacts 330 are arranged in a single row.

In an exemplary embodiment, the first mating contacts 308 are electrically connected with the second mating contacts 330, which are both arranged as differential signal pairs of contacts. Optionally, both the first and second contacts 308, 330 are integrally formed with one another such that the contacts are exposed at both the first and second mating ends 326, 328. Compensation may be provided by controlling the positions of the contacts with respect to one another between the first and second mating ends 326, 328. Alternatively, the first and second mating contacts 308, 330 are interconnected by a circuit board (not shown) that is received within the plug body 304. Additionally, the circuit board may provide electrical compensation for controlling the electrical characteristics of the signal pairs. For example, the electrical characteristics may be matched to particular standards that govern the first and second wiring system.

Figure 11:
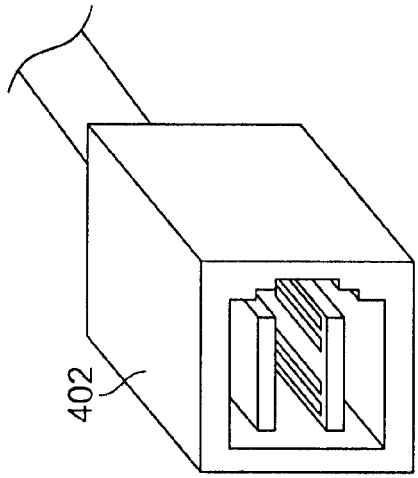
FIG. 11 is a rear perspective view of the electrical connector shown in FIG. 9.
Figure 11:
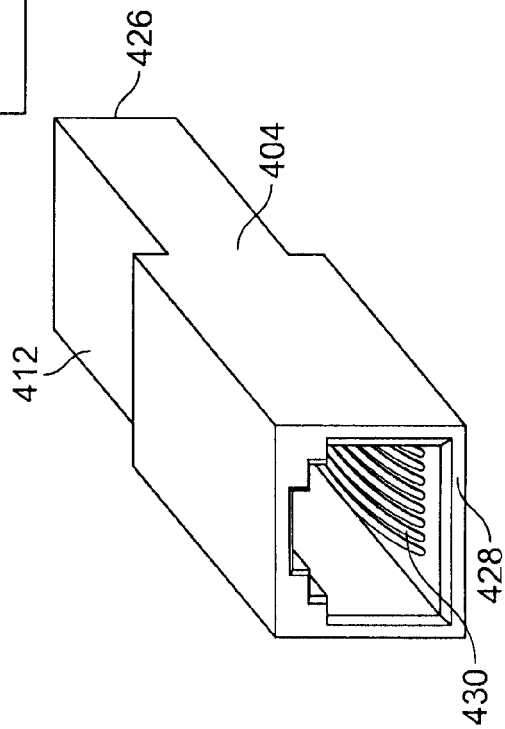
Figure 10:
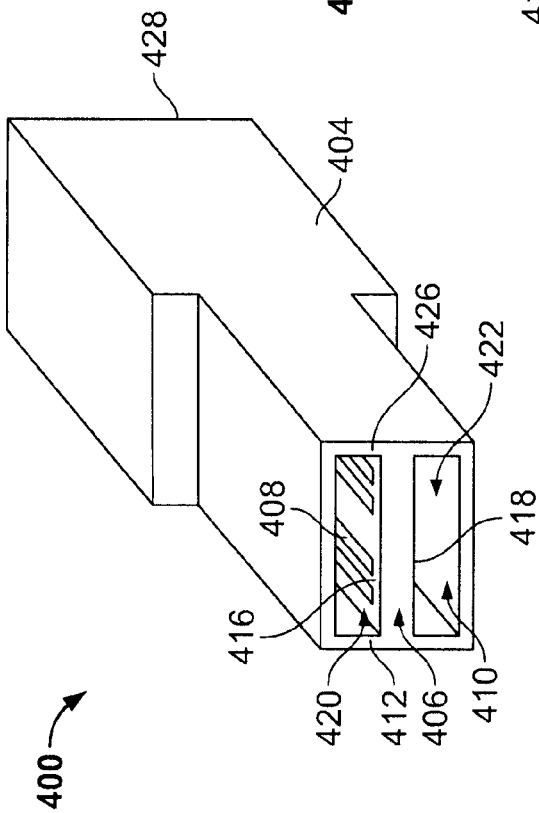
FIG. 10 is a front perspective view of yet another electrical connector formed in accordance with a further alternative embodiment.
Figure 10:
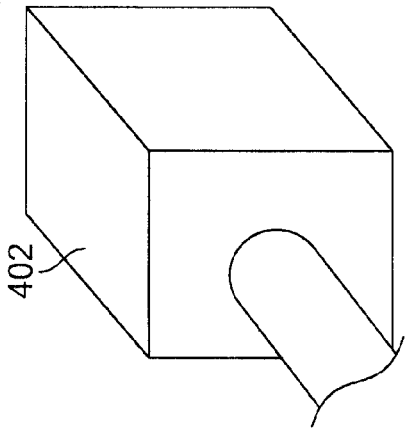

FIGS. 10 and 11 are front and rear perspective views of another electrical connector 400 formed in accordance with another alternative embodiment. A mating connector 402 may be coupled to the electrical connector 400. The electrical connector 400 includes a plug body 404 and a web portion 406 having a plurality of first mating contacts 408 for mating with the mating connector 402. The electrical connector 400 represents a receptacle connector having a cavity 410 that receives the mating connector.

The plug body 404 includes outer body walls 412 defining an outer perimeter of the plug body 404. The outer perimeter of the plug body 404 defines a mating interface that is received within a receptacle of the mating connector 402. The web portion 406 is provided within the cavity 410. The web portion 406 includes opposed sides 416, 418 and extends between two of the outer body walls 412. First and second channels 420, 422 are formed between the web portion 406 and the outer body walls 412. The channels 420, 422 define a space sized and shaped to accept a portion of the mating connector therein. The first mating contacts 408 extend along the first and second sides 416, 418 of the web portion 406 such that the first mating contacts 408 face, and are exposed to, respective ones of the channels 420, 422.

The plug body 404 extends between a first mating end 426 and a second mating end 428. The electrical connector 400 defines a plug connector at the first mating end 426 for connection with a receptacle-type mating connector 402. The first mating end 426 and the mating connector 402 have a mating interface defined for use within a first wiring system, wherein plugs and receptacles within the first wiring system have a mating interface similar to that shown in FIGS. 10 and 11. As shown in FIG. 11, the electrical connector 400 defines a receptacle type connector at the second mating end 428 for mating with a corresponding plug type of connector (not shown). The second mating end 428 and the corresponding connector have a mating interface defined for use within a second wiring system, wherein plugs and receptacles within the second wiring system have a mating interface similar to that shown in FIGS. 10 and 11. The mating interface defined at the second mating end 428 is different than the mating interface at the first mating end 426, such that the second mating end 428 could not receive a plug connector having a mating interface of the type at the first mating end 322. The electrical connector 400 may be used as an adaptor for interconnecting components or cables from the first wiring system with components or cables from the second wiring system.

In an exemplary embodiment, the second mating end 428 represents an 8P8C modular connector, such as an RJ-45 jack or other type of connector used within a network cabling system. The second mating end 428 includes second mating contacts 430. In the illustrated embodiment, eight second mating contacts 430 are provided and the second mating contacts 430 are arranged in a single row.

In an exemplary embodiment, the first mating contacts 408 are electrically connected with the second mating contacts 430, which are both arranged as differential signal pairs of contacts. Optionally, both the first and second contacts 408, 430 are integrally formed with one another such that the contacts are exposed at both the first and second mating ends 426, 428. Compensation may be provided by controlling the positions of the contacts with respect to one another between the first and second mating ends 426, 428. Alternatively, the first and second mating contacts 408, 430 are interconnected by a circuit board (not shown) that is received within the plug body 404. Additionally, the circuit board may provide electrical compensation for controlling the electrical characteristics of the signal pairs. For example, the electrical characteristics may be matched to particular standards that govern the first and second wiring system.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein," Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a plug body having a cavity defined by outer body walls, the outer body walls include two opposed major walls and two opposed minor walls, the major walls being longer than the minor walls, the plug body includes a deflectable latch extending outward from one of the minor walls, the latch being configured to secure the plug body within a receptacle of a mating connector, the cavity has a cavity axis extending between a mating end and a base end of the cavity, the plug body includes a web portion integrally formed with the plug body, the web portion being positioned within the cavity, the web portion extends along the cavity axis and includes a first side and a second side, the first and second sides are spaced apart from, and generally face, corresponding ones of the outer body walls, wherein the plug body is configured to be received within a receptacle of a mating connector, and wherein a portion of the mating connector is received within the cavity along the first and second sides of the web portion when the plug body is mated within the mating connector; and a plurality of contacts arranged on the web portion in differential pairs, wherein a first differential pair of contacts is positioned on the first side and a second differential pair of contacts is positioned on the second side for interfacing with the mating connector.

2. The connector of claim 1, wherein the cavity includes a first channel extending along the first side of the web portion and a second channel extending along the second side of the web portion, the first and second channels are configured to receive portions of the mating connector, wherein the contacts are exposed to one of the first and second channels for mating engagement with the mating connector.

3. The connector of claim 1, wherein the first and second sides of the web portion are parallel to, and spaced apart from, the opposed major walls, and wherein the web portion extends from at least one of the minor walls.

4. The connector of claim 1, wherein the cavity concentrically surrounds the web portion from the base end to the mating end.

5. The connector of claim 1, wherein the plug body is configured to be received within the receptacle of the mating connector in a co-nested arrangement having the plug body surrounded by the receptacle and having the plug body surrounding a perimeter of a portion of the mating connector along a mating axis.

6. The connector of claim 1, wherein the cavity is configured to receive a mating portion of the mating connector such that the mating portion of the mating connector extends along and engages the contacts positioned on both the first side and the second side of the web portion.

7. The connector of claim 1, wherein the first differential pair includes a cross-over section for controlling an electrical interaction with an adjacent one of the differential pairs, the contacts of the first and second differential pairs are substantially aligned with one another across the web portion, the contacts of the first differential pair are aligned with different ones of the contacts of the second differential pair forward of the cross-over section as compared to rearward of the cross-over section.

8. The connector of claim 1, wherein the outer body walls define a plug body perimeter being sized substantially similar to an eight conductor cable typical of an eight pin, eight conductor modular plug.

9. The connector of claim 1, wherein the major walls are parallel to one another, and wherein the minor walls are parallel to one another.

10. The connector of claim 1, wherein the plug body is configured to be received within the receptacle of the mating connector such that a majority of each of the outer body walls are received within the receptacle.

11. An electrical connector comprising:

a plug body having an outer perimeter extending between a mating end and a wire terminating end, the outer perimeter configured to be received within a receptacle of a mating connector when mated thereto, the plug body having a cavity open at the mating end for receiving a portion of the mating connector, the plug body having a web portion at the first mating end having a first side and a second side, the web portion being configured for plugging into a portion of the first mating connector, and the plug body having wire receiving ports at the wire terminating end for receiving individual wires therein; and first, second, third and fourth contacts positioned within the cavity for mating with the mating connector, the contacts are configured to be electrically connected to respective ones of the wires, the contacts are arranged as differential pairs, wherein the first and second contacts define a first differential pair arranged along the first side of the web portion in a first plane and the third and fourth contacts define a second differential pair arranged along the second side of the web portion in a second plane that is substantially parallel to the first plane, the contacts of the first and second differential pairs are substantially aligned with one another along the length of the contacts, the contacts of the first differential pair have a cross-over section approximately centered along the length such that the first contact is aligned with the third contact and the fourth contact for approximate equal portions of the length of the first contact, and such that the second contact is aligned with the third contact and the fourth contact for approximate equal portions of the length of the second contact, wherein the cavity is defined by outer body walls, the web portion being formed integral with the outer body walls, the outer body walls include two opposed major walls and two opposed minor walls, the major walls being longer than the minor walls, the plug body includes a deflectable latch extending outward from one of the minor walls, the latch being configured to secure the plug body within a receptacle of a mating connector.

12. The connector of claim 11, further comprising a third differential pair and a fourth differential pair, the contacts of the third differential pair being coplanar with the contacts of the first differential pair.

13. The connector of claim 11, wherein the cross-over section is arranged along the length to provide compensation between the contacts of the first and second differential pairs by substantially equalizing the amount of coupling between the contacts of the first and second differential pairs.

14. The connector of claim 11, wherein the contacts extend between a mating end and a termination end, the termination end configured to be terminated to the wires.

15. The connector of claim 11, wherein the contacts extend between a mating end and a termination end, the termination end having insulation displacement contacts configured to electrically connect to the wires.

16. The connector of claim 11, wherein the plug body includes a hinged wire receiving element at the wire terminating end thereof, the wire receiving element having the wire receiving ports for receiving the wires and the wire receiving element being movable between an unmated position, in which the wires are loaded into the wire receiving ports, and a mated position, in which the wires are electrically connected to respective ones of the contacts.

17. An electrical connector comprising:

a plug body having a first mating end and a second mating end, wherein the first mating end has an outer perimeter configured to be received within a receptacle of a first mating connector when mated thereto, the plug body having a cavity and web portion at the first mating end, the cavity being configured for receiving a portion of the first mating connector and the web portion being configured for plugging into a portion of the first mating connector, and wherein the second mating end has mating contacts for engaging a second mating connector; and a plurality of contacts received within the cavity for mating with the first mating connector, the contacts arranged on the web portion in differential pairs, wherein a first differential pair of contacts are positioned on a first side of the web portion and a second differential pair of contacts are positioned on a second side of the web portion, wherein the contacts are electrically connected to respective ones of the mating contacts at the second mating end of the plug body, and wherein the contacts have a compensation region for changing at least one of an inter-pair electrical characteristic and an intra-pair electrical characteristic to correspond with the second mating connector;

wherein the second mating connector has an RJ-45 connector interface and the second mating connector provides compensation for cross-talk created by the RJ-45 connector interface, wherein the compensation region causes the contacts to have predetermined electrical characteristics at the second mating end indicative of a typical RJ-45 mating interface.

18. The connector of claim 17, wherein the contacts at the first mating end are arranged in a first pattern having substantially parallel contact axes arranged in two different parallel planes, and wherein the mating contacts at the second mating end have a different pattern from the first pattern.

19. The connector of claim 17, wherein the plug body defines an adapter having a first mating interface at the first mating end configured to mate with the first mating connector of a wiring system of a first type, and the adapter has a second mating interface at the second mating end configured to mate with the second mating connector of a wiring system of a second type, different from the first type of wiring system.

20. The connector of claim 17, wherein the plug body defines a receptacle at the second mating end, the receptacle configured to mate with a plug connector having a different mating interface than a mating interface of the plug body at the first mating end.

21. The connector of claim 17, wherein the compensation region induces cross-talk in the connector to change the electrical characteristics between the contacts from low cross-talk at the first mating end to high cross-talk at the second mating end.

* * * * *